US008597477B2

(12) United States Patent
Navarro et al.

(10) Patent No.: US 8,597,477 B2
(45) Date of Patent: Dec. 3, 2013

(54) CONTACT BAR ASSEMBLY, SYSTEM INCLUDING THE CONTACT BAR ASSEMBLY, AND METHOD OF USING SAME

(75) Inventors: Rafael Garcia Navarro, Silver City, NM (US); Luis A. Gonzalez Olguin, Copiapó (CL); Luis Ricardo Olivares, Calama (CL); Larry R. Todd, Calama (CL); Mark Peabody, Morenci, AZ (US); Casey J. Clayton, Calama (CL); Scot P. Sandoval, Morenci, AZ (US)

(73) Assignee: Freeport-McMoran Corporation, Phoenix, AZ (US)

( * ) Notice: Subject to any disclaimer, the term of this patent is extended or adjusted under 35 U.S.C. 154(b) by 115 days.

(21) Appl. No.: 13/028,973

(22) Filed: Feb. 16, 2011

(65) Prior Publication Data

US 2012/0205254 A1 Aug. 16, 2012

(51) Int. Cl.

| | |
|---|---|
| ***C25B 9/02*** | (2006.01) |
| ***C25C 7/00*** | (2006.01) |
| ***C25D 17/04*** | (2006.01) |
| ***C25D 17/06*** | (2006.01) |
| ***C25D 17/08*** | (2006.01) |

(52) U.S. Cl.

USPC ..... 204/279; 204/228.1; 204/230.2; 204/267; 204/278.5; 204/286.1; 205/574; 205/602

(58) Field of Classification Search

USPC ..... 204/267, 278.5, 286.1, 297.01, 228.1, 204/230.2, 279

See application file for complete search history.

(56) References Cited

U.S. PATENT DOCUMENTS

| | | | | |
|---|---|---|---|---|
| 4,035,280 | A * | 7/1977 | Deane et al. | 204/267 |
| 4,479,863 | A * | 10/1984 | Honey et al. | 204/279 |
| 6,342,136 | B1 * | 1/2002 | Virtanen et al. | 204/242 |
| 7,993,501 | B2 * | 8/2011 | Ashford et al. | 204/267 |
| 2005/0121319 | A1 * | 6/2005 | Dufresne | 204/297.1 |
| 2005/0145481 | A1 * | 7/2005 | Kivisto et al. | 204/198 |
| 2005/0284753 | A1 * | 12/2005 | Dufresne | 204/288 |
| 2008/0035473 | A1 * | 2/2008 | Anastasijevic et al. | 204/242 |
| 2009/0139857 | A1 | 6/2009 | Ebert | |
| 2009/0152124 | A1 * | 6/2009 | Ashford et al. | 205/574 |
| 2010/0065423 | A1 * | 3/2010 | Dufresne | 204/297.01 |
| 2010/0258435 | A1 * | 10/2010 | Vidaurre Heiremans | 204/269 |
| 2011/0073468 | A1 * | 3/2011 | Virtanen et al. | 204/267 |
| 2011/0132753 | A1 * | 6/2011 | Dufresne | 204/297.01 |
| 2011/0284369 | A1 * | 11/2011 | Ashford et al. | 204/230.2 |

OTHER PUBLICATIONS

International Search Report and Written Opinion from corresponding International Application No. PCT/US2012/023587, dated Oct. 4, 2012.

Written Opinion of the International Preliminary Examining Authority from corresponding International Application No. PCT/US2012/023587, dated Oct 19, 2013.

International Preliminary Report on Patentability fron corresponding International Application No. PCT/US2012/023587, dated May 24, 2013.

* cited by examiner

*Primary Examiner* — Bruce Bell

(74) *Attorney, Agent, or Firm* — Snell & Wilmer L.L.P.

(57) ABSTRACT

The present invention relates to a contact bar assembly for use in a multi-cell electrolytic system for recovery of metal, to a system including the contact bar assembly, and to a method of using the assembly and system. The contact bar assembly includes a base cap board, a primary bar having a plurality of primary bar structures formed thereon, an auxiliary bar having a plurality of auxiliary bar structures formed thereon, and a top cap board, wherein the base cap board includes slots to receive the primary bar and the auxiliary bar, and wherein the top cap board includes a plurality of openings to receive the plurality of primary bar structures and the plurality of auxiliary bar structures. A system includes the contact bar assembly, an anode assembly, a cathode assembly, and a tank.

14 Claims, 9 Drawing Sheets

CONTACT BAR ASSEMBLY, SYSTEM INCLUDING THE CONTACT BAR ASSEMBLY, AND METHOD OF USING SAME

FIELD OF INVENTION

The present invention relates, generally, to a contact bar assembly for a multi-cell electrolytic metal recovery system and to systems including the assembly. More particularly, the invention relates to a contact bar assembly configured to couple multiple anodes together and multiple cathodes together in a multi-cell metal recovery system, to a system including the contact bar assembly, and to methods of using the assembly and system.

BACKGROUND OF THE INVENTION

Electrowinning and electrorefining are often used in hydrometallurgical processing of ore to recover metal, such as copper, silver, platinum group metals, molybdenum, zinc, nickel, cobalt, uranium, rhenium, rare earth metals, combinations thereof, and the like from ore. The recovery of metal from ore often includes exposing the ore to a leaching process (e.g., atmospheric leaching, pressure leaching, agitation leaching, heap leaching, stockpile leaching, thin-layer leaching, vat leaching, or the like) to obtain a pregnant leach solution including desired metal ions, optionally, purifying and concentrating the pregnant leach solution, using, e.g., a solvent extraction process, and then recovering the metal, using an electrowinning and/or electrorefining process.

An electrolytic system for electrowinning and/or electrorefining may include a plurality of electrolytic cells. Each cell generally includes an anode assembly, a cathode assembly that is spaced apart from the anode assembly, and an electrolyte solution between an active portion of the anode assembly and an active portion of the cathode assembly. In the case of electrowinning, metal is recovered from the solution by applying a bias across the cathode assembly and the anode assembly sufficient to cause the metal ions in solution to reduce onto an active area of the cathode. In the case of electrorefining, the anode assembly includes relatively impure metal, and upon application of a sufficient bias between the anode assembly and the cathode assembly, a portion of the anode dissolves in the electrolyte and refined metal from the anode is deposited onto the active area of the cathode assembly.

In the case of multi-cell electrowinning and electrorefining systems, the multiple cells may reside within one or more tanks, and the cells may be in a parallel and/or serial configuration. The multi-cell system may include a contact bar assembly to couple multiple anode assemblies and multiple cathode assemblies together, such that desired power can be simultaneously applied to multiple assemblies from a single power source.

In typical multi-cell systems, the anode and/or cathode assemblies may be askew, such that the spacing between adjacent anode assemblies and cathode assemblies are not consistent across the active areas of the anode and cathode assemblies. In addition, the cathode assemblies and the anode assemblies may be off-center relative to each other. And, the spacing between adjacent cathode assemblies and anode assemblies may not be the same or consistent. Also, the systems may allow for only limited contact between the respective assemblies and portions of the contact bar assembly. Further, the cathode and/or anode assemblies may not sit horizontally within the tank. Accordingly, improved contact bar assemblies and electrolytic systems are desired.

SUMMARY OF THE INVENTION

The present invention generally relates to electrolytic cells and systems for recovery of metal. More particularly, the invention relates to an improved contact bar assembly for multi-cell electrolytic systems, to systems including the improved contact bar assembly, and to methods of using the system and assembly.

While the ways in which the present invention addresses the drawbacks of the prior art are discussed in greater detail below, in general, the contact bar assembly and metal recovery system are designed to allow more even and consistent spacing between anode active areas and cathode active areas, facilitate better contact between the cathode and anode assemblies and portions of the contact bar assembly, and facilitate more even plating of metal across active areas of the cathode assemblies.

In accordance with various embodiments of the invention, a contact bar assembly includes a base cap board, a primary bar having a plurality of primary bar structures for receiving and forming multiple lines of contact with a portion of a cathode assembly, an auxiliary bar having a plurality of auxiliary bar structures, each auxiliary bar structure configured for receiving and forming multiple lines of contact with a portion of an anode assembly, and a top cap board, wherein the base cap board optionally includes slots to receive the primary bar and the auxiliary bar, and wherein the top cap board includes a plurality of openings to receive the plurality of primary bar structures and the plurality of auxiliary bar structures. In accordance with various aspects of these embodiments, the auxiliary bar and the primary bar are configured such that when an anode assembly and a cathode assembly are received by the contact bar assembly, an active area of the anode assembly and an active area of the cathode assembly are centered relative to each other. In accordance with additional aspects of these embodiments, the auxiliary bar and the primary bar are configured such that when an anode assembly and a cathode assembly are received by the contact bar assembly, the anode assembly and the cathode assembly are relatively horizontal. In accordance with further aspects of these exemplary embodiments, the primary bar includes a recess to receive a hanger bar of a cathode assembly. In accordance with yet further aspects, the auxiliary bar structure includes a recess to receive a hanger bar of an anode assembly. In accordance with yet additional aspects, the base cap board includes slots and/or holes to promote electrolyte drainage or return to a tank. In accordance with further aspects, the contact bar assembly includes a plurality of auxiliary bars. And, in accordance with yet further aspects of these exemplary embodiments, the primary bar includes about two recesses for each structure on the auxiliary bar.

In accordance with additional exemplary embodiments of the invention, a system for recovering metal includes a tank, at least one contact bar assembly on a wall of the tank, the contact bar assembly including a base cap board, a primary bar having a plurality of primary bar structures configured for receiving and forming multiple lines of contact with a portion of a cathode assembly, an auxiliary bar having a plurality of auxiliary structures, each auxiliary bar structure configured for receiving and forming multiple lines of contact with a portion of an anode assembly, and a top cap board, wherein the base cap board optionally includes slots to receive the primary bar and the auxiliary bar, and wherein the top cap board includes a plurality of openings to receive the plurality of primary bar structures and the plurality of auxiliary bar structures, at least one anode assembly, and at least one cathode assembly. In accordance with various aspects of these embodiments, the base cap board is centered on the tank wall. In accordance with additional aspects of these embodiments, the contact bar assembly includes a second auxiliary bar. In accordance with further aspects, the system includes a plurality of contact bar assemblies.

In accordance with yet additional embodiments of the invention, a method for recovering metal includes providing a contact bar assembly including a base cap board, a primary bar having a plurality of primary bar structures configured for receiving and forming multiple lines of contact with a portion of a cathode assembly, an auxiliary bar having a plurality of auxiliary bar structures, each auxiliary bar structure configured for receiving and forming multiple lines of contact with a portion of an anode assembly, and a top cap board, wherein the base cap board optionally includes slots to receive the primary bar and the auxiliary bar, and wherein the top cap board includes a plurality of openings to receive the plurality of primary bar structures and the plurality of auxiliary bar structures, providing an anode assembly, providing a cathode assembly, and applying a bias across the anode assembly and the cathode assembly sufficient to cause metal to deposit onto an active area of the cathode assembly. In accordance with various aspects of these embodiments, the step of applying includes simultaneously applying power to a plurality of anode assemblies coupled together with the auxiliary bar. In accordance with additional aspects of these embodiments, the step of applying includes simultaneously applying power to a plurality of cathode assemblies coupled together with the primary bar.

These and other features and advantages of the present invention will become apparent upon a reading of the following detailed description when taken in conjunction with the drawing figures, wherein there is shown and described various illustrative embodiments of the invention.

BRIEF DESCRIPTION OF THE DRAWING FIGURES

The exemplary embodiments of the present invention will be described in connection with the appended drawing figures in which like numerals denote like elements and:

Figure 3A:
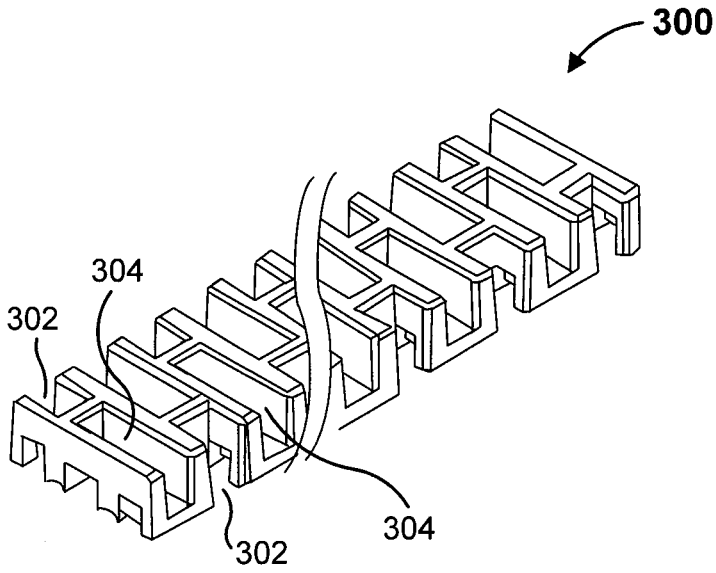
Figure 3B:
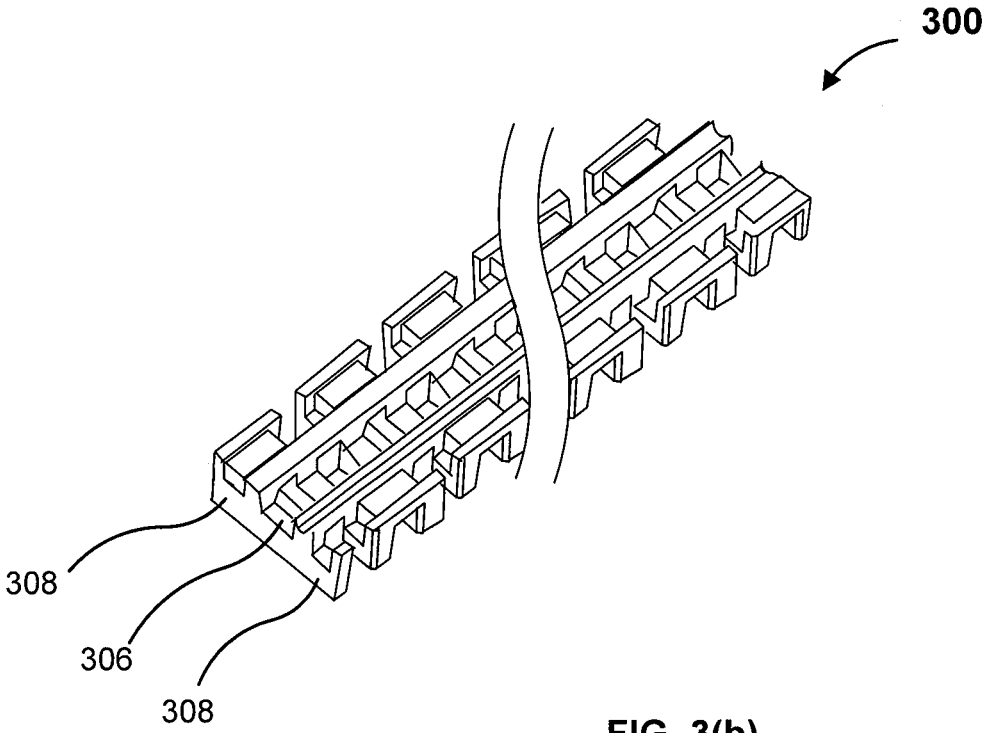
Figure 4A:
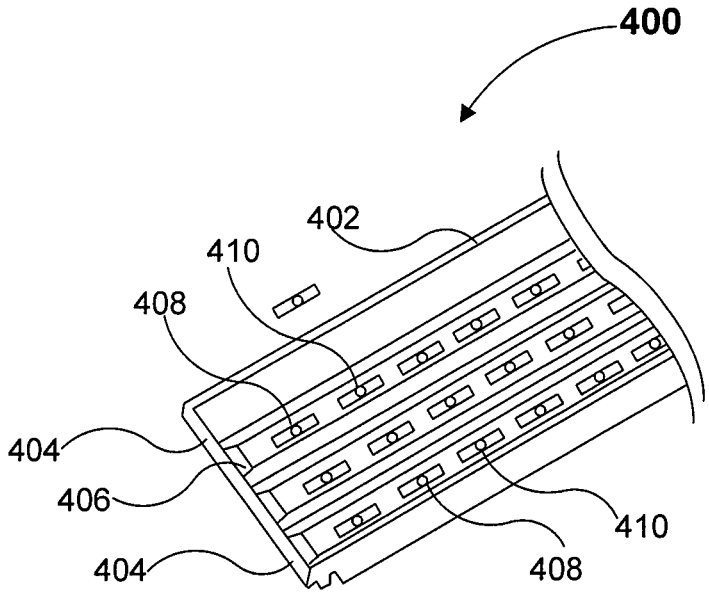
Figure 4B:
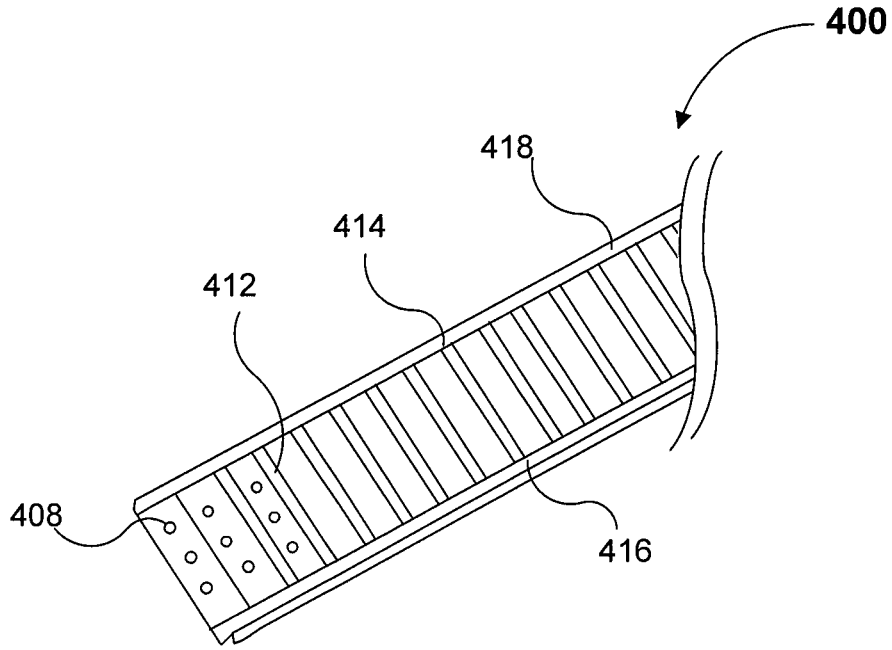
Figure 5:
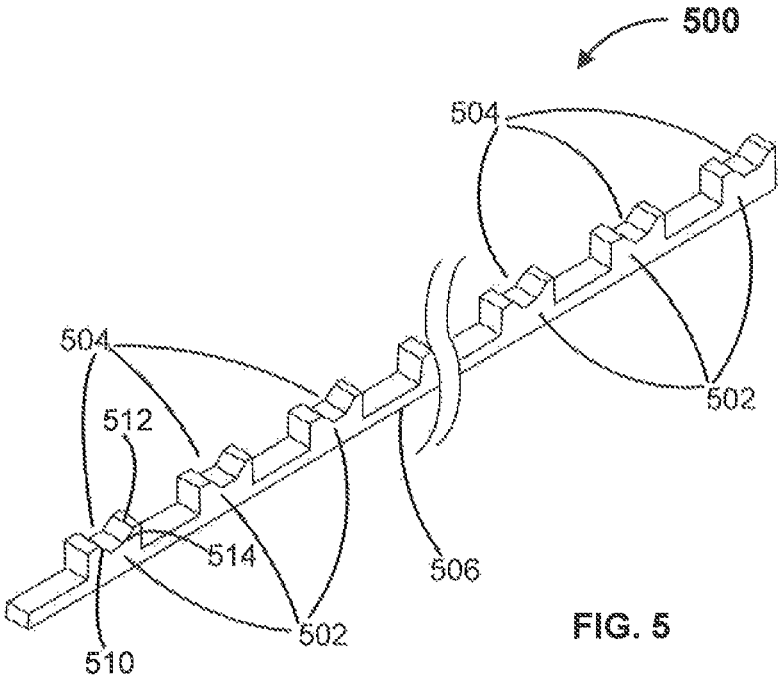
Figure 6:
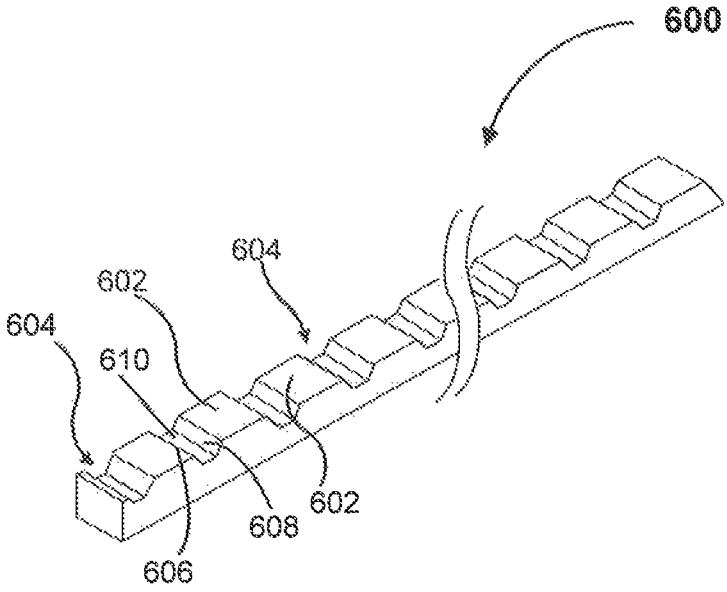
Figure 7:
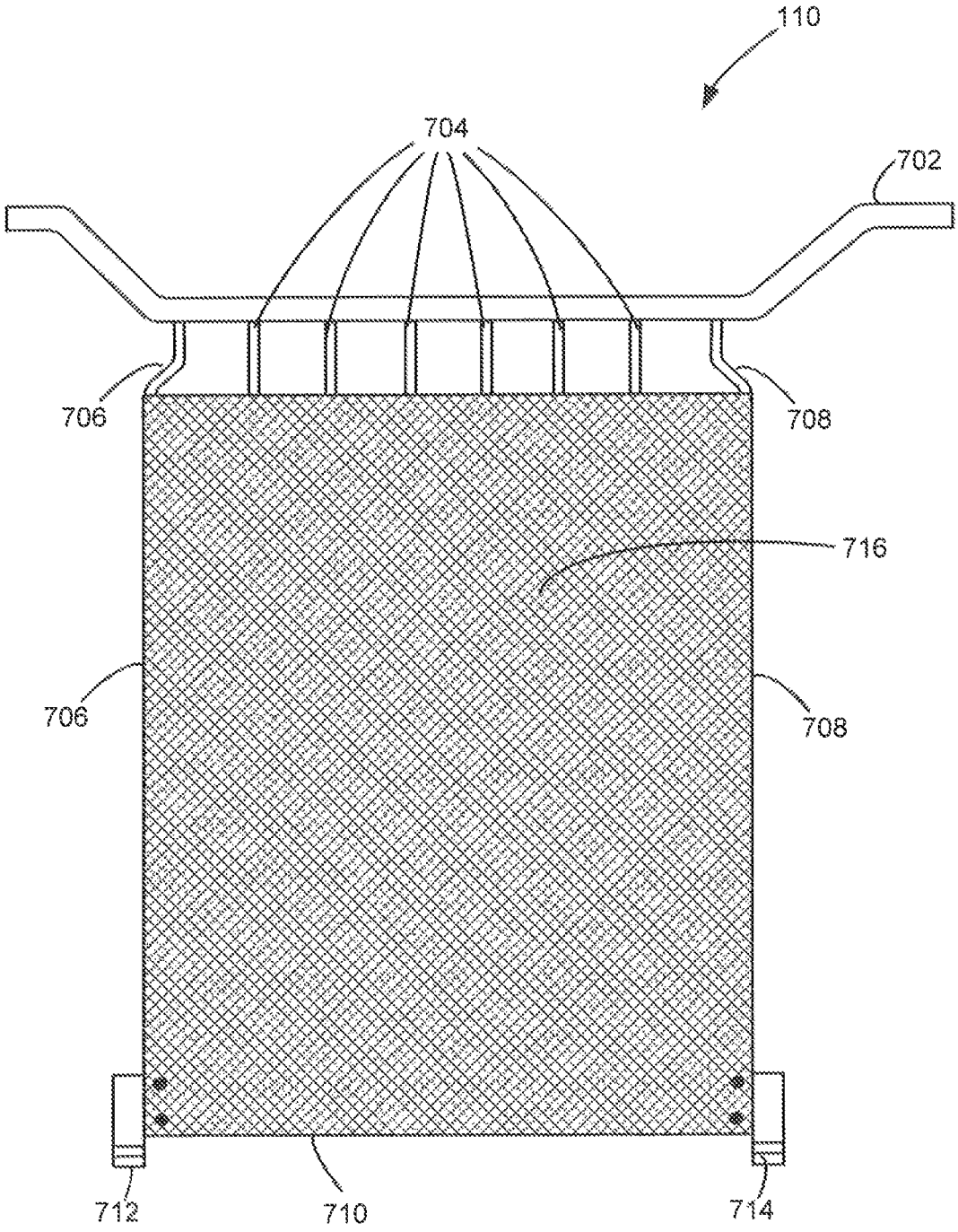
Figure 8:
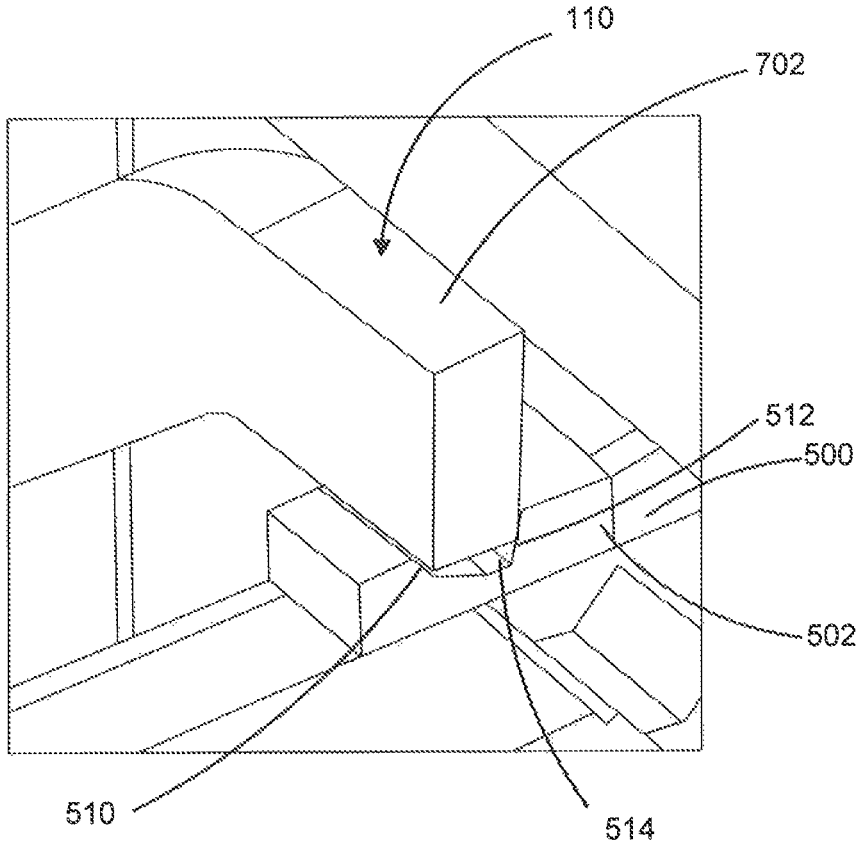
Figure 9:
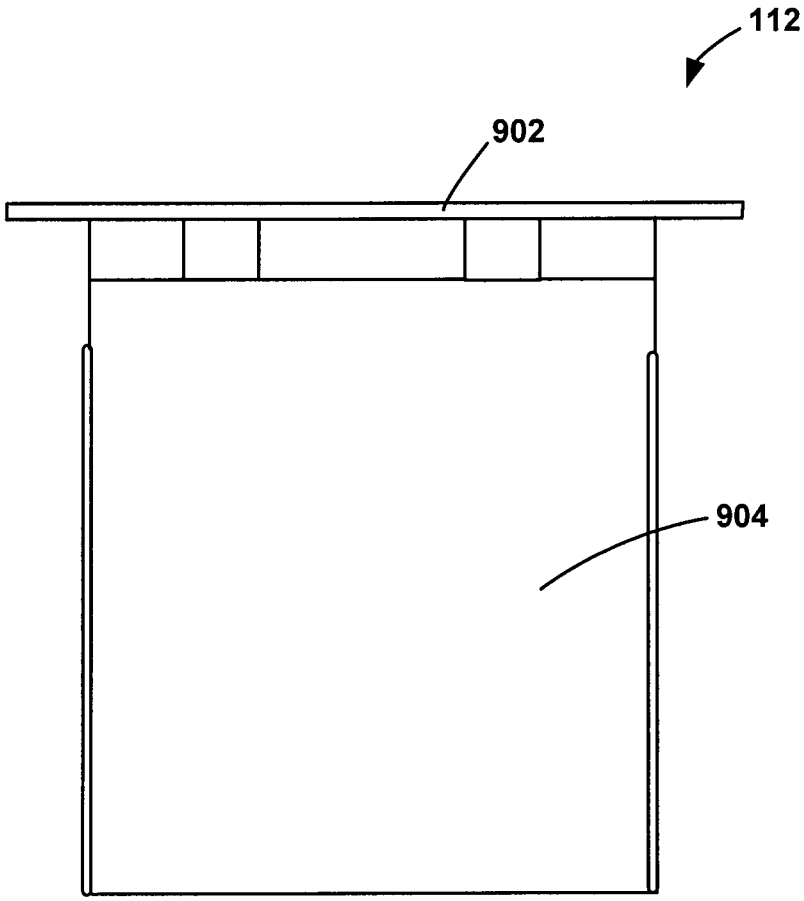
Figure 10:
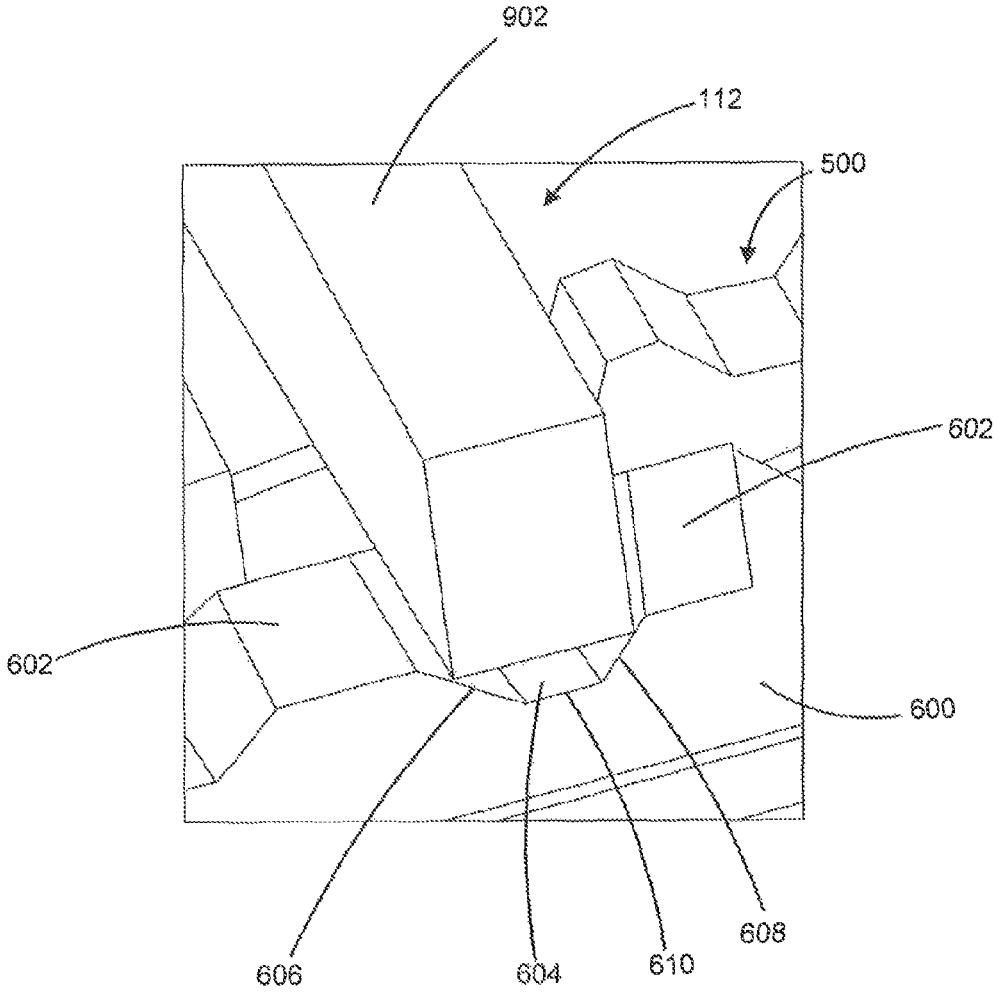

FIGS. 3(*a*) and 3(*b*) illustrate a top view and a bottom view of a top cap board in accordance with exemplary embodiments of the invention;

FIGS. 4(*a*) and 4(*b*) illustrate a top view and a bottom view of a base cap board in accordance with exemplary embodiments of the invention;

FIG. 5 illustrates an auxiliary bar in accordance with exemplary embodiments of the invention;

FIG. 6 illustrates a primary bar in accordance with exemplary embodiments of the invention;

FIG. 7 illustrates an anode assembly in accordance with exemplary embodiments of the invention;

FIG. 8 illustrates a portion of an anode assembly coupled to an auxiliary bar in accordance with exemplary embodiments of the invention;

FIG. 9 illustrates a cathode assembly in accordance with exemplary embodiments of the invention; and FIG. 10 illustrates a portion of a cathode assembly coupled to a primary bar in accordance with yet further exemplary embodiments of the invention.

It will be appreciated that elements in the figures are illustrated for simplicity and clarity and have not necessarily been drawn to scale. For example, the dimensions of some of the elements in the figures may be exaggerated relative to other elements to help to improve understanding of illustrated embodiments of the present invention.

DETAILED DESCRIPTION OF THE INVENTION

The description of exemplary embodiments of the present invention provided below is merely exemplary and is intended for purposes of illustration only; the following description is not intended to limit the scope of the invention disclosed herein. Moreover, recitation of multiple embodiments having stated features is not intended to exclude other embodiments having additional features or other embodiments incorporating different combinations of the stated features.

The present invention provides an improved cap board assembly for use in electrolytic metal recovery systems, a system including the cap board assembly, and a method of using the cap board assembly and the system. As set forth in more detail below, the cap board assembly and system including the assembly provide relatively even spacing between an anode assembly and a cathode assembly, facilitate centering of a cathode assembly and an anode assembly relative to each other, allow for both a cathode assembly and an anode assembly to sit relatively horizontal within the system (i.e., within a tank), allow a cathode assembly and an anode assembly to form multiple lines of contact with the contact bar assembly, and facilitate recycling of electrolyte solution to a tank within the system.

The contact bar assembly and system described herein can be used in a variety of applications, such as electrowinning and/or electrorefining various metals. For convenience, the contact bar assembly, system, and method are described below in connection with electrowinning metal from solution. The assembly can be used to recover, for example, metals such as copper, gold, silver, zinc, platinum group metals, nickel, chromium, cobalt, manganese, molybdenum, rhenium, uranium, rare earth metals, alkali metals, alkaline metals, and the like. By way of particular example, the contact bar assembly, system, and method of the present invention are described in connection with recovery of copper from hydrometallurgical processing of copper sulfide ores and/or copper oxide ores.

Figure 1:
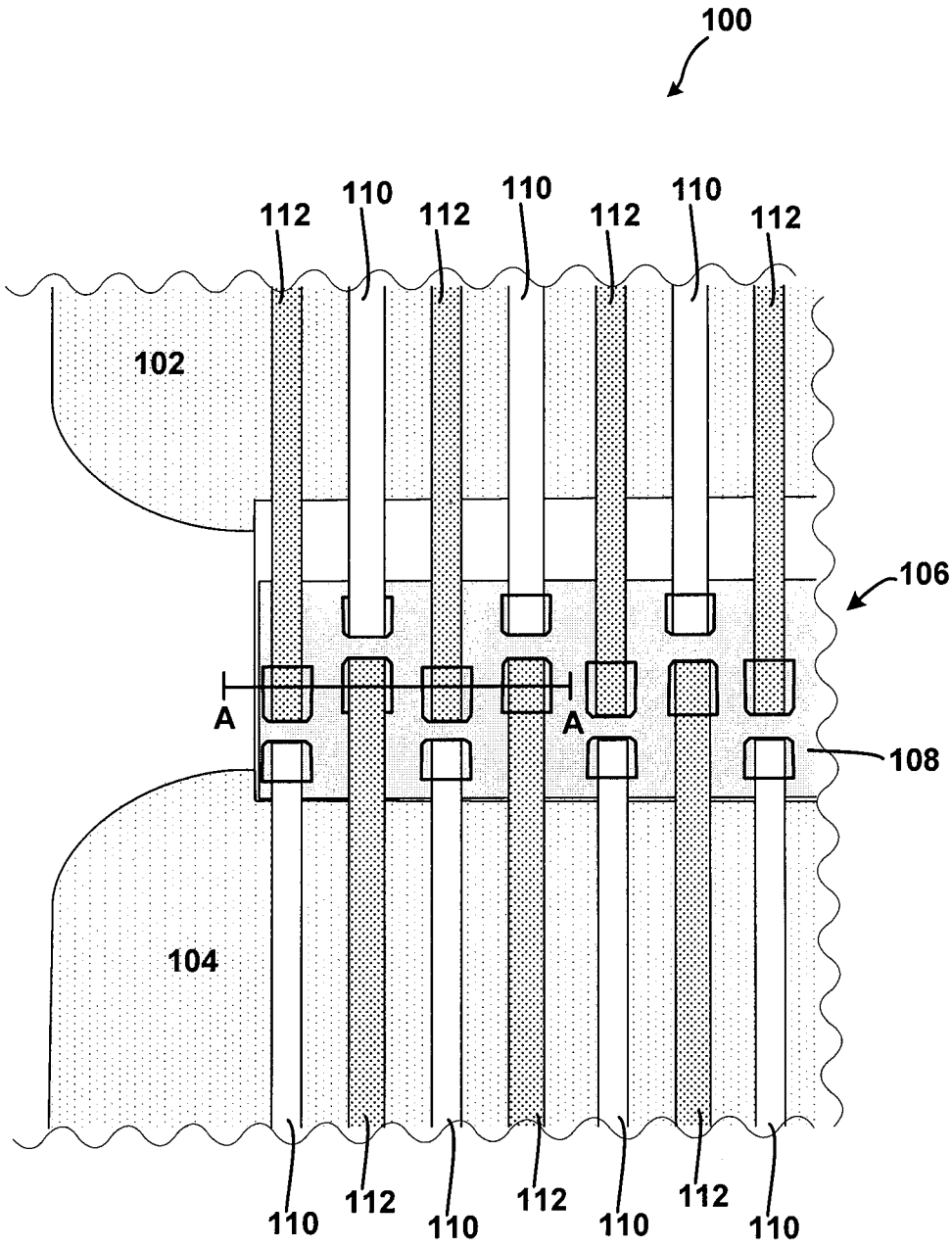
FIG. 1 illustrates a plan view of a portion of a metal recovery system in accordance with exemplary embodiments of the invention.
Figure 2:
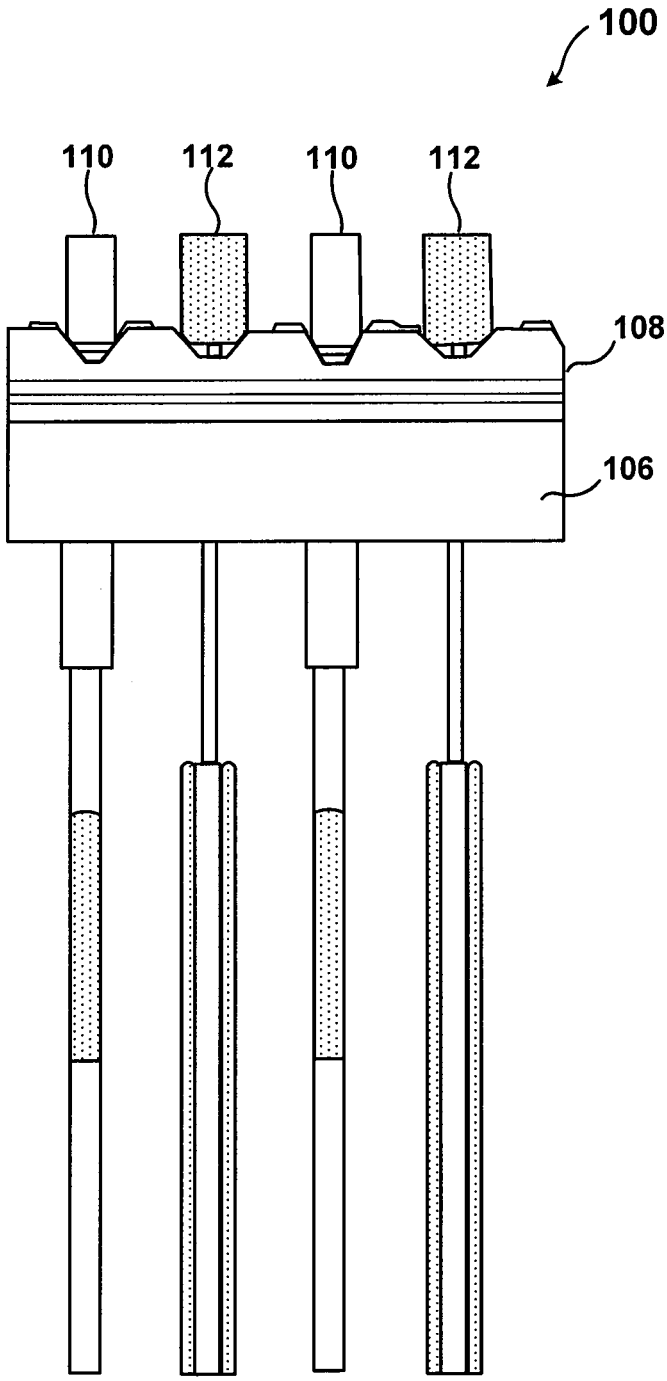
FIG. 2 illustrates a cross-sectional view of a portion of a metal recovery system in accordance with exemplary embodiments of the invention.

FIG. 1 schematically illustrates a plan view and FIG. 2 illustrates a cut-away view (along line A-A in FIG. 1) of a portion of a metal recovery system 100 in accordance with various exemplary embodiments of the invention. In the illustrated example, system 100 includes a first tank 102, a second tank 104, a wall 106, a contact bar assembly 108 overlying a portion of wall 106, anode assemblies 110, and cathode assemblies 112.

System 100 may include any suitable number of tanks and any suitable number of anode and cathode assemblies. Anode assemblies 110 and cathode assemblies 112 may be coupled together in series and/or in parallel within a tank or over multiple tanks. System 100 may also include solution (e.g., electrolyte) flow and drainage systems, filtering systems, and the like (not illustrated) to provide desired flow of solution within and between cells of system 100.

Tanks 102, 104 may be formed of any suitable material, such as polymer concrete, fiberglass, plastic-lined concrete, stainless steel, or plastics, such as polypropylene, polyethylene, PVC, or the like. By way of example, system 100 includes about 50 tanks 102, 104 to about two hundred tanks 102, 104 and tanks 102, 104 are formed of polymer concrete.

Turning now to FIGS. 2, 3(*a*)-3(*b*), 4(*a*)-4(*b*), 5, and 6, contact bar assembly 108, in accordance with exemplary embodiments of the invention, is illustrated in greater detail. As set forth in more detail below, contact bar assemblies 108 are designed to receive, hold in place, and provide power to multiple anode assemblies 110 and multiple cathode assemblies 112 within a tank and in an adjacent tank. For example, with reference to FIG. 1, contact bar assembly 108 provides power to multiple anode assemblies 110 in tanks 102 and 104 and also provides power to multiple cathode assemblies 112 in tanks 102 and 104.

In accordance with various exemplary embodiments of the invention, contact bar assembly 108 includes a top cap board 300 (illustrated in FIGS. 3(*a*) and 3(*b*)), a base cap board 400 (illustrated in FIGS. 4(*a*) and 4(*b*)), and at least one auxiliary bar or equalizer bar 500 (illustrated in FIG. 5) and at least one primary or inter-cell bar 600 (illustrated in FIG. 6) interposed between base cap board 400 and top cap board 300. Exemplary ways top cap board 300, base cap board 400, auxiliary bar 500, and primary bar 600 may be assembled are discussed below. Once the components are assembled, top cap board 300 and base cap board 400 may be coupled together using a variety of techniques, such as snap fit, use of fasteners, use of adhesives, or the like.

FIGS. 3(*a*) and 3(*b*) illustrate a top and bottom view of top cap board 300 in accordance with various embodiments of the invention. Top cap board 300 includes a plurality of first top recesses 302 and a plurality of second top recesses 304 for respectfully allowing access to portions of auxiliary bar 500 and primary bar 600, such that a portion of anode assembly 110 can contact auxiliary bar 500 and a portion of cathode assembly 112 can contact primary bar 600, as illustrated in FIG. 1. With reference to FIG. 3(*b*), a bottom portion of top cap board 300 includes a first bottom recess 306 to receive a portion of primary bar 600 and at least one recess 308 to receive a portion of auxiliary bar 500. Recesses 306, 308 help maintain top cap board 300 position relative to auxiliary bar 500 and primary bar 600 and reduce or minimize movement of bars 500, 600 relative to top cap board 300.

Top cap board 300 also provides support for anode assemblies 110 and cathode assemblies 112 and further provides insulation between assemblies 110, 112. Top cap board 300 may be formed of a variety of insulating materials such as epoxy, fiberglass reinforced epoxy, or plastic, and by way of one example, top cap board 300 is formed of fiberglass reinforced epoxy.

FIGS. 4(*a*) and 4(*b*) respectfully illustrate at top and a bottom view of base cap board 400 in accordance with exemplary embodiments of the invention. In the illustrated example, a top 402 of base cap board 400 includes first grooves 404 for receiving a portion auxiliary bar 500 and a second groove 406 for receiving a portion primary bar 600. Grooves 404 and 406 help maintain a position of bars 500, 600 relative to base cap board 400. In the illustrated example, board 400 also includes holes 408 and slots 410 to allow fluid, such as the electrolyte solution to flow through board 400 and into tanks 102, 104.

A bottom 418 of base cap board 400 includes reinforcing ribs 412 and side rails 414, 416. Side rails 414, 416 facilitate centering of base cap board 400 and contact bar assembly 108 over tank wall 106, as illustrated in FIGS. 1 and 2. Reinforcing ribs 412 provide additional support to base cap board 400 in a direction substantially perpendicular to the direction of auxiliary bar 500 and primary bar 600. Base cap board 400 may be formed of a variety of materials, and in accordance with various embodiments of the invention, board 400 is formed of fiberglass reinforced epoxy.

FIG. 5 illustrates an equalization or auxiliary bar 500 in accordance with various embodiments of the invention. Bar 500 includes one or more auxiliary bar structures 502, each structure 502 having a recess 504 formed therein to receive a portion of anode assembly 110. Recess 504 may be formed in a variety of configurations. In accordance with various embodiments of the invention, recess 504 is configured to form multiple lines of contact with a portion of anode assembly 110. In this context, multiple lines of contact mean at least two lines of contact and may include continuous surface contact. In the illustrated embodiment, recess 504 includes a first slanted wall 510, a second slanted wall 512, and a base 514.

As noted above, a portion (e.g., a bottom portion 506) of auxiliary bar 500 is received within groove 404 of base cap board 400 and at least a portion of structures 502 extends through opening 302 in top cap board 300 to allow contact of bar 500 with anode assemblies 110.

Bar 500 may be formed of any suitable conductive material, such as copper, silver, gold, aluminum, chromium, alloys thereof, combinations thereof, or the like. By way of one example, bar 500 is formed of copper.

Primary bar 600, illustrated in FIG. 6, includes primary bar structures 602, having recesses 604 formed between adjacent structures 602. Structures 602 and recesses 604 are configured to receive a portion of cathode assembly 112 and to form multiple lines of contact with assembly 112 within recess 604. In accordance with the illustrated example, recess 604 includes a first slanted wall 606, a second slanted wall 608, and a base.

While a number of auxiliary bar structures 502 and primary bar recesses 604 may vary in accordance with a variety of factors, such as a desired number of anode assemblies 110 and cathode assemblies 112 within a tank, in accordance with various examples of the invention, contact bar assembly 118 includes one primary bar 600 and two auxiliary bars 500, and bar 600 has twice as many recesses as each auxiliary bar 500 has structures (+/− about 2), such that the system (e.g., system 100) includes an equal number of anode assemblies 110 and cathode assemblies 112 in contact with bars 500 and 600, respectfully.

Auxiliary bar 500 and primary bar 600, along with contact bar assembly 108, are configured to facilitate even spacing along active areas of anode assemblies 110 and cathode assemblies 112 and to provide even and consistent spacing between anode assemblies 110 and cathode assemblies 112. To this end, adjacent contact bar assemblies 108, and bars 500 and 600 contained therein, are generally aligned, so that parallel and adjacent assemblies 110 and 112 are generally parallel to each other and evenly spaced. In addition, assemblies 108 and bars 500 and 600 contained therein are configured such that assemblies 110 and 112 are relatively horizontal relative to tanks 102, 104.

FIG. 7 illustrates an exemplary anode assembly 110 suitable for use with various exemplary embodiments of the invention. Assembly 110 includes a hanger bar 702, one or more center conductor bars 704, a first perimeter bar 706, a second perimeter bar 708, a base bar 710, a first insulating separator 712, a second insulating separator 714, and at least one active substrate 716. Assembly 110 may also include a second active substrate (not shown) on an opposite side of bars 704 relative to illustrated substrate 716.

With reference to FIG. 8, hanger bar 702 of anode assembly 110 is designed to form electrical contact with auxiliary bar 500 along at least two lines of contact. In the illustrated example, hanger bar 702 includes a rectangular cross section and recess 504 includes slanted sidewalls 510, 512 to receive hanger bar 702 to form at least two lines of contact—along slanted sidewalls 510, 512 and bottom edges of bar 702. In accordance with alternative embodiments, hanger bar and/or recess 504 may have alternative configurations to allow additional lines of contact, including continuous surface contact.

FIG. 9 illustrates cathode assembly 112, including a hanger bar 902 and an active surface 904. FIG. 10 illustrates a portion of hanger bar 902 in contact with primary bar 600 in greater detail, showing multiple lines of contact between the bottom edges of hanger bar 902 and slanted walls 606 and 608, within recess 604 of primary bar 600.

Although the invention has been conveniently described above in connection with anode assemblies 110 forming contact with auxiliary bar 500 and cathode assemblies 112 forming contact with primary bar 600, it is understood that in accordance with alternative embodiments, anode assemblies 110 may form contact with primary bar 600 and cathode assemblies may form contact with auxiliary bar 500.

Furthermore, although the illustrated examples are described in connection with contact bar assembly 108 including one primary bar 600 and two auxiliary bars 500, contact bar assemblies 108 in accordance with the present invention may include any suitable number of auxiliary bars 500 and primary bars 600.

The present invention has been described above with reference to a number of exemplary embodiments and examples. It should be appreciated that the particular embodiments shown and described herein are illustrative of the invention and its best mode and are not intended to limit in any way the scope of the invention as set forth in the claims. It will be recognized that changes and modifications may be made to the exemplary embodiments without departing from the scope of the present invention. These and other changes or modifications are intended to be included within the scope of the present invention, as expressed in the following claims.

The invention claimed is:

1. A contact bar assembly comprising:

a base cap board, wherein the base cap board comprises holes to promote drainage of electrolyte solution;

a primary bar having a plurality of primary bar structures for receiving and forming multiple lines of contact with a portion of a cathode assembly;

a first auxiliary bar having a first plurality of auxiliary bar structures;

a second auxiliary bar having a second plurality of auxiliary bar structures, wherein each of the first and second plurality of auxiliary bar structures is configured for receiving and forming multiple lines of contact with a portion of an anode assembly; and a top cap board, wherein the base cap board comprises a first slot to receive the primary bar, a second slot to receive the first auxiliary bar, and a third slot to receive the second auxiliary bar, wherein the second slot and third slot are located on either side of and parallel to the first slot, and wherein the top cap board comprises a first plurality of openings to receive the plurality of primary bar structures and a second plurality of openings to receive the plurality of auxiliary bar structures.

2. The contact bar assembly of claim 1, wherein the base cap board comprises slots to promote drainage of electrolyte solution.

3. The contact bar assembly of claim 1, wherein the base cap board comprises a plurality of side rails to facilitate centering the base cap hoard over a tank wall.

4. The contact bar assembly of claim 1, wherein the primary bar comprises a plurality of recesses, each recess formed between adjacent primary bar structures, and wherein the multiple lines of contact with a portion of a cathode assembly are formed within each recess.

5. The contact bar assembly of claim 4, wherein the plurality of recesses are each formed from a first slanted wall, a second slanted wall, and a base.

6. The contact bar assembly of claim 1, wherein the primary bar comprises twice +/−2 as many recesses as the auxiliary bar has auxiliary bar structures.

7. The contact bar assembly of claim 1, wherein each of the first and second pluralities of auxiliary bar structures comprise a recess, and wherein the multiple lines of contact with a portion of an anode assembly are formed within each recess.

8. The contact bar assembly of claim 7, wherein the recess comprises a first slanted wall, a second slanted wall, and a base.

9. The contact bar assembly of claim 1, wherein the base cap board and the top cap board are couple together using snap fit techniques, fastener techniques, or an adhesive.

10. A system for recovering metal, the system comprising:

a tank including a wall;

a cathode assembly;

an anode assembly; and at least one contact bar assembly on the wall; the contact bar assembly comprising a base cap board, a primary bar having a plurality of primary bar structures for receiving and forming multiple lines of contact with a portion of the cathode assembly, a first auxiliary bar having a first plurality of auxiliary bar structures, a second auxiliary bar having a second plurality of auxiliary bar structures, each of the first and second auxiliary bar structures having a recess to receive an form multiple lines of contact with a portion of the anode assembly, and a top cap board, wherein the base cap board includes a first slot to receive a portion of the primary bar, a second slot to receive a portion of the first auxiliary bar, and a third slot to receive a portion of the second auxiliary bar, and wherein the second slot and third slot are located on either side of and parallel to the first slot, and wherein the base cap board comprises holes to promote drainage of electrolyte solution.

11. The system, for recovering metal of claim 10, wherein the base cap board is centered over the wall.

12. The system for recovering metal of claim 10, wherein the contact bar assembly is configured to hold the anode assembly horizontal and to hold the cathode assembly horizontal.

13. The system for recovering metal of claim 10, wherein the contact bar assembly is configured to hold a plurality of anode assemblies alternating with a plurality of cathode assemblies, wherein the spacing between adjacent anode assemblies and cathode assemblies is the same.

14. A method for recovering metal, the method comprising the steps of:

providing an anode assembly;

providing a cathode assembly;

providing a contact bar assembly comprising a base cap board, a primary bar having a plurality of primary bar structures configured for receiving and forming multiple lines of contact with a portion of the cathode assembly, a first auxiliary bar comprising a first plurality of auxiliary bar structures, a second auxiliary bar comprising a second plurality of auxiliary bar structures, wherein each of the first and second auxiliary bar structure is configured for receiving and forming multiple lines of contact with a portion of the anode assembly, and a top cap board, wherein the base cap board includes a first slot to receive a portion of the primary bar, a second slot to receive a portion of the first auxiliary bar, and a third slot to receive a portion of the second auxiliary bar, and wherein the second slot and third slot are located on either side of and parallel to the first slot, and wherein the base cap board comprises holes to promote drainage of electrolyte solution; and applying a bias across the anode assembly and the cathode assembly to plate metal onto a portion of the cathode assembly.

* * * * *